US011091817B2

(12) United States Patent
Yang et al.

(10) Patent No.: US 11,091,817 B2
(45) Date of Patent: Aug. 17, 2021

(54) HIGH-STRENGTH STEEL SHEET AND METHOD FOR MANUFACTURING THE SAME

(71) Applicant: JFE Steel Corporation, Tokyo (JP)

(72) Inventors: Lingling Yang, Tokyo (JP); Noriaki Kohsaka, Tokyo (JP); Tatsuya Nakagaito, Tokyo (JP); Yoshimasa Funakawa, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 244 days.

(21) Appl. No.: 16/324,975

(22) PCT Filed: Aug. 29, 2017

(86) PCT No.: PCT/JP2017/030845
§ 371 (c)(1),
(2) Date: Feb. 12, 2019

(87) PCT Pub. No.: WO2018/043452
PCT Pub. Date: Mar. 8, 2018

(65) Prior Publication Data

US 2019/0185955 A1 Jun. 20, 2019

(30) Foreign Application Priority Data

Aug. 30, 2016 (JP) ..... JP2016-168117

(51) Int. Cl.
*C21D 8/02* (2006.01)
*C21D 9/46* (2006.01)
(Continued)

(52) U.S. Cl.
CPC ..... *C21D 8/0263* (2013.01); *C21D 9/46* (2013.01); *C21D 9/563* (2013.01); *C22C 38/00* (2013.01);
(Continued)

(58) Field of Classification Search
None
See application file for complete search history.

(56) References Cited

U.S. PATENT DOCUMENTS 8,657,969 B2 2/2014 Kawasaki et al.
9,157,132 B2 10/2015 Kaneko et al.
(Continued)

FOREIGN PATENT DOCUMENTS

CN 101657558 A 2/2010
CN 102918174 A 2/2013
(Continued)

OTHER PUBLICATIONS

Chinese Office Action for Chinese Application No. 201780049617.4, dated May 22, 2020 with Concise Statement of Relevance of Office Action, 9 pages.
(Continued)

*Primary Examiner* — Anthony J Zimmer
*Assistant Examiner* — Dean Mazzola
(74) *Attorney, Agent, or Firm* — RatnerPrestia

(57) ABSTRACT

Provided are a high-strength steel sheet having high strength of a yield strength of 550 MPa or more and a method for manufacturing the same.
The high-strength steel sheet has a specified chemical composition and a microstructure, where observed in a cross section in a thickness direction perpendicular to a rolling direction, including a martensite phase having a volume fraction of 50% to 80%, and a ferrite phase having an average grain diameter of 13 μm or less, wherein a volume fraction of ferrite grains having an aspect ratio of 2.0 or less with respect to the whole ferrite phase is 70% or more, and wherein an average length in a longitudinal direction (in a width direction of the steel sheet) of the ferrite grains is 20 μm or less, and a yield strength (YP) of 550 MPa or more.

22 Claims, 1 Drawing Sheet

(51) Int. Cl.

| | |
|---|---|
| ***C22C 38/14*** | (2006.01) |
| ***C22C 38/60*** | (2006.01) |
| ***C21D 9/56*** | (2006.01) |
| ***C22C 38/00*** | (2006.01) |
| ***C22C 38/06*** | (2006.01) |
| ***C22C 38/08*** | (2006.01) |
| ***C22C 38/10*** | (2006.01) |
| ***C22C 38/12*** | (2006.01) |
| ***C22C 38/16*** | (2006.01) |
| ***C22C 38/22*** | (2006.01) |
| ***C22C 38/28*** | (2006.01) |
| ***C22C 38/32*** | (2006.01) |
| ***C22C 38/34*** | (2006.01) |
| ***C22C 38/38*** | (2006.01) |
| ***C23C 2/02*** | (2006.01) |
| ***C23C 2/06*** | (2006.01) |
| ***C23C 2/40*** | (2006.01) |

(52) U.S. Cl.

CPC ..... *C22C 38/002* (2013.01); *C22C 38/005* (2013.01); *C22C 38/008* (2013.01); *C22C 38/06* (2013.01); *C22C 38/08* (2013.01); *C22C 38/10* (2013.01); *C22C 38/12* (2013.01); *C22C 38/14* (2013.01); *C22C 38/16* (2013.01); *C22C 38/22* (2013.01); *C22C 38/28* (2013.01); *C22C 38/32* (2013.01); *C22C 38/34* (2013.01); *C22C 38/38* (2013.01); *C22C 38/60* (2013.01); *C23C 2/02* (2013.01); *C23C 2/06* (2013.01); *C23C 2/40* (2013.01); *C21D 8/0205* (2013.01); *C21D 8/0226* (2013.01); *C21D 8/0236* (2013.01); *C21D 2211/005* (2013.01); *C21D 2211/008* (2013.01)

(56) References Cited

U.S. PATENT DOCUMENTS

| | | | | |
|---|---|---|---|---|
| 9,982,318 | B2 | 5/2018 | Kaneko et al. | |
| 2010/0132848 | A1* | 6/2010 | Ikeda | C22C 38/04 148/507 |
| 2016/0273066 | A1 | 9/2016 | Sakakibara et al. | |
| 2017/0029914 | A1 | 2/2017 | Hayashi | |
| 2017/0137906 | A1* | 5/2017 | Fan | B32B 15/013 |

FOREIGN PATENT DOCUMENTS

| | | | | |
|---|---|---|---|---|
| CN | 103857820 | A | 6/2014 | |
| CN | 103857821 | A | 6/2014 | |
| CN | 105829564 | A | 8/2016 | |
| EP | 2138599 | A1 | 12/2009 | |
| EP | 2578718 | A1 | 4/2013 | |
| EP | 2757171 | A1 | 7/2014 | |
| EP | 2762603 | A1 | 8/2014 | |
| EP | 3050989 | A1 | 8/2016 | |
| JP | 2004332099 | A | 11/2004 | |
| JP | 2006219738 | A | 8/2006 | |
| JP | 2009209451 | A | 9/2009 | |
| JP | 2010126787 | A | 6/2010 | |
| JP | 2010209392 | A | 9/2010 | |
| JP | 2011225915 | A | 11/2011 | |
| JP | 2014005514 | A | 1/2014 | |
| JP | 5928374 | B2 | 6/2016 | |
| WO | 2014046027 | A1 | 3/2014 | |
| WO | 2014185405 | A1 | 11/2014 | |
| WO | 2015080242 | A1 | 6/2015 | |
| WO | 2015185956 | A1 | 12/2015 | |
| WO | WO-2015185975 | A1 * | 12/2015 | C21D 8/0205 |
| WO | 2016103534 | A1 | 6/2016 | |

OTHER PUBLICATIONS

Extended European Search Report for European Application No. 17846457.4, dated Jul. 26, 2019, 9 pages.

International Search Report and Written Opinion for International Application No. PCT/JP2017/030845, dated Nov. 28, 2017—6 pages.

Korean Office Action for Korean Application No. 10-2019-7003965, dated Aug. 14, 2020, with Concise Statement of Relevance of Office Action, 6 pages.

Non Final Office Action for Application No. 16/328,087, dated Mar. 3, 2021, 11 pages.

* cited by examiner

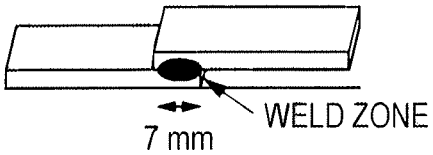
(a)
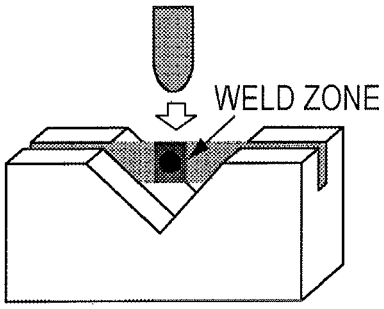
(b)
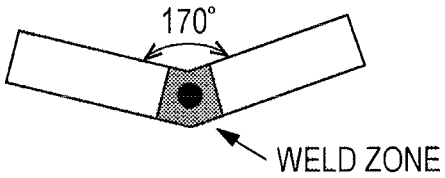
(c)
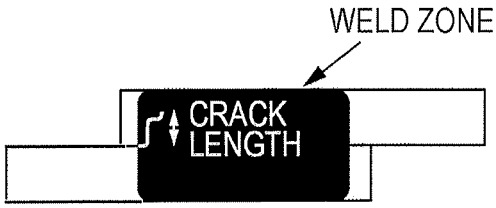
(d)

HIGH-STRENGTH STEEL SHEET AND METHOD FOR MANUFACTURING THE SAME

CROSS REFERENCE TO RELATED APPLICATIONS

This is the U.S. National Phase application of PCT/JP2017/030845, filed Aug. 29, 2017, which claims priority to Japanese Patent Application No. 2016-168117, filed Aug. 30, 2016, the disclosures of these applications being incorporated herein by reference in their entireties for all purposes.

FIELD OF THE INVENTION

The present invention relates to a high-strength steel sheet which is used mainly as a material for automobile parts and a method for manufacturing the steel sheet. More specifically, the present invention relates to a high-strength steel sheet having high strength represented by yield strength of 550 MPa or more and excellent weldability, and to a method for manufacturing the steel sheet.

BACKGROUND OF THE INVENTION

Nowadays, for example, in the automobile industry, improving the fuel efficiency of automobiles to decrease the amount of carbon dioxide gas ($CO_2$) emission continues to be an important issue to be addressed from the viewpoint of global environment conservation. Although decreasing the weight of automobile bodies is effective for improving the fuel efficiency of automobiles, it is necessary to decrease the weight of automobile bodies while maintaining satisfactory strength of the automobile bodies. It is possible to achieve weight reduction in the case where an automobile structure can be simplified to decrease the number of parts and the thickness of the material can be decreased by increasing the strength of a steel sheet which is used as a material for automobile parts.

However, in the case of a high-strength steel sheet having yield strength of 550 MPa or more where large amounts of alloy elements, which are necessary to increase strength, are typically added, there is a decrease in the toughness of a weld zone, in particular, the toughness of a heat-affected zone in the vicinity of a melt-solidified zone, which is called a nugget, when resistance spot welding is performed, often resulting in a fracture occurring in the weld zone at the time of an automobile collision, and, as a result, it is not possible to maintain satisfactory collision strength of the whole automobile body. Although various techniques have been proposed to date, none are directly intended to improve the strength of such a welded joint.

For example, Patent Literature 1 discloses a high-strength hot-dip coated steel sheet having a TS of 980 MPa or more which is excellent in terms of formability and impact resistance and a method for manufacturing the steel sheet. In addition, Patent Literature 2 discloses a high-strength hot-dip coated steel sheet having a TS: 590 MPa or more and excellent workability and a method for manufacturing the steel sheet. In addition, Patent Literature 3 discloses a high-strength hot-dip coated steel sheet having a TS of 780 MPa or more and excellent formability and a method for manufacturing the steel sheet. In addition, Patent Literature 4 discloses a high-strength cold-rolled steel sheet having excellent forming workability and weldability and a method for manufacturing the steel sheet. In addition, Patent Literature 5 discloses a high-strength thin steel sheet having a TS of 800 MPa or more which is excellent in terms of hydrogen embrittlement resistance, weldability, hole expansion formability, and ductility and a method for manufacturing the steel sheet.

PATENT LITERATURE

PTL 1: Japanese Unexamined Patent Application Publication No. 2011-225915

PTL 2: Japanese Unexamined Patent Application Publication No. 2009-209451

PTL 3: Japanese Unexamined Patent Application Publication No. 2010-209392

PTL 4: Japanese Unexamined Patent Application Publication No. 2006-219738

PTL 5: Japanese Unexamined Patent Application Publication No. 2004-332099

SUMMARY OF THE INVENTION

In the case of the high-strength hot-dip coated steel sheet according to Patent Literature 1, it is difficult to achieve a high strength represented by yield strength of 550 MPa or more, and there is a decrease in the toughness of a heat-affected zone. Therefore, there is room for improvement in torsional strength under a condition of high-speed deformation.

In the case of the high-strength hot-dip coated steel sheet according to Patent Literature 2, since the steel has a microstructure including, in terms of area fraction, 30% or more and 90% or less of a ferrite phase, 3% or more and 30% or less of a bainite phase, and 5% or more and 40% or less of a martensite phase, it is difficult to achieve a high strength represented by yield strength of 550 MPa or more, and there is a decrease in the toughness of a heat-affected zone. Therefore, there is room for improvement in torsional strength under a condition of high-speed deformation.

In the case of the high-strength hot-dip coated steel sheet according to Patent Literature 3, it is difficult to achieve a high strength represented by yield strength of 550 MPa or more, and there is a decrease in the toughness of a heat-affected zone and the toughness of the heat-affected zone is deteriorated. Therefore, there is room for improvement in torsional strength under a condition of high-speed deformation.

In the case of the high-strength hot-dip coated steel sheet according to Patent Literature 4, Patent Literature 4 states that it is possible to obtain a steel sheet having excellent weldability by controlling a Ceq value to be 0.25 or less. However, although such a technique is effective in relation to conventional static tensile shear and peeling strength, it may be said that there is insufficient toughness in consideration of a configuration factor regarding a ferrite phase. Therefore, there is room for improvement in torsional strength under a condition of high-speed deformation.

In the case of a microstructure proposed in Patent Literature 5, since bainite and/or bainitic ferrite are included in a total amount of 34% to 97% in terms of area fraction, there is room for improvement in torsional strength under a condition of high-speed deformation.

As described above, in the case of all the conventional techniques, since there is a problem to be solved regarding torsional strength under the condition of high-speed deformation, and since, for example, there is a case where fracture is practically prevented by using reinforcing members, it may now be said that there is an insufficient effect of weight reduction.

Aspects of the present invention are intended to advantageously solve the problems of the conventional techniques described above, and an object according to aspects of the present invention is to provide a high-strength steel sheet which has high strength represented by yield strength of 550 MPa or more and with which it is possible to form a resistance spot weld zone having increased torsional strength under the condition of high-speed deformation and a method for manufacturing the steel sheet. Here, in accordance with aspects of the present invention, the expression "excellent weldability" refers to increased torsional strength under the condition of high-speed deformation. The expression "increased torsional strength under the condition of high-speed deformation" refers to a case where no crack is generated or a case where a crack having a length of 50 μm or less is generated when, after a test piece has been prepared by overlapping two steel sheets, across the full width thereof, which have a width of 10 mm, a length of 80 mm, a thickness of 1.6 mm and whose longitudinal direction is a direction perpendicular to the rolling direction and by performing spot welding so that the nugget diameter is 7 mm, vertically fixed, and applied with a test force of a forming load of 10 kN at a loading speed of 100 mm/min so as to be deformed so that the spot weld zone between the two steel sheets forms an angle of 170°, a cross section in the thickness direction parallel to the rolling direction is subjected to mirror polishing without etching and magnified by using an optical microscope at a magnification of 400 times to determine whether a crack exists in the weld zone.

To achieve the object described above, the present inventors eagerly conducted investigations regarding the torsional strength of a resistance spot weld zone under the condition of high-speed deformation and, as a result, obtained the following knowledge by changing a microstructure, which has yet to be subjected to welding heat, to increase the toughness of a heat-affected zone.

(1) In the case where a torsion test is performed under the condition of high-speed deformation, a crack is generated in a heat-affected zone in a direction (in the thickness direction) perpendicular to the rolling direction in a nugget.

(2) It is possible to inhibit a crack from being generated in such a direction by controlling a microstructure in a cross section in the thickness direction perpendicular to the rolling direction to be a microstructure including a martensite phase and a ferrite phase, in which the volume fraction of the martensite phase is 50% to 80%, in which the average grain diameter of the ferrite phase is 13 μm or less, in which the volume fraction of ferrite grains having an aspect ratio of 2.0 or less with respect to the whole ferrite phase is 70% or more, and in which the average length in the longitudinal direction of ferrite grains is 20 μm or less.

(3) In the case where a large number of ferrite grains elongated in the width direction exist in the parent phase of a heat-affected zone, since stress is concentrated at the tips of the grains elongated in the width direction, voids tend to be generated when the tips of the grains are located adjacent to, for example, hard martensite. Then, as a result of voids combining with each other, a crack is easily generated in the vicinity of a nugget. As a result, since a crack is generated in a direction (in the thickness direction) perpendicular to the rolling direction in a nugget in a torsion test under a condition of high-speed deformation, there is a decrease in strength.

Aspects of the present invention have been completed on the basis of the knowledge described above, and, more specifically, aspects of the present invention provide the following.

[1] A high-strength steel sheet having: a chemical composition containing, by mass %, C: 0.05% to 0.15%, Si: 0.010% to 1.80%, Mn: 1.8% to 3.2%, P: 0.05% or less, S: 0.02% or less, Al: 0.01% to 2.0%, one or more of B: 0.0001% to 0.005%, Ti: 0.005% to 0.04%, and Mo: 0.03% to 0.50%, and the balance being Fe and inevitable impurities, a microstructure, where observed in a cross section in a thickness direction perpendicular to a rolling direction, including a martensite phase having a volume fraction of 50% to 80%, and a ferrite phase having an average grain diameter of 13 μm or less, wherein a volume fraction of ferrite grains having an aspect ratio of 2.0 or less with respect to the whole ferrite phase is 70% or more, and wherein an average length in a longitudinal direction (in a width direction of the steel sheet) of the ferrite grains is 20 μm or less, and a yield strength (YP) of 550 MPa or more.

[2] The high-strength steel sheet according to item [1], wherein the microstructure further includes an average grain diameter of the martensite phase being 2 μm to 8 μm where observed in a cross section in the thickness direction perpendicular to the rolling direction.

[3] The high-strength steel sheet according to item [1] or [2], wherein the chemical composition further contains, by mass %, Cr: 1.0% or less.

[4] The high-strength steel sheet according to any one of items [1] to [3], wherein the chemical composition further contains, by mass %, one or more of Cu, Ni, Sn, As, Sb, Ca, Mg, Pb, Co, Ta, W, REM, Zn, Nb, V, Cs, and Hf of 1% or less in total.

[5] The high-strength steel sheet according to any one of items [1] to [4], the steel sheet further having a coating layer on a surface of the steel sheet.

[6] The high-strength steel sheet according to item [5], wherein the coating layer is a galvanizing layer or a galvannealing layer.

[7] A method for manufacturing a high-strength steel sheet, the method having a hot-rolling process including: hot-rolling a steel slab having the chemical composition according to any one of items [1], [3], and [4], cooling at an average cooling rate of 10° C./s to 30° C./s, and coiling at a coiling temperature of 470° C. to 700° C.; a cold-rolling process in which the hot-rolled steel sheet obtained in the hot-rolling process is cold-rolled; and an annealing process including: heating the cold-rolled steel sheet obtained in the cold-rolling process to an annealing temperature range of 750° C. to 900° C., holding the heated steel sheet at the annealing temperature range for 30 seconds to 200 seconds, wherein the steel sheet is subjected to reverse bending through rolls having a radius of 200 mm or more eight times or more in total during the holding, and cooling to a cooling stop temperature of 400° C. to 600° C. at an average cooling rate of 10° C./s or more.

[8] The method for manufacturing a high-strength steel sheet according to item [7], the method further having a coating process wherein the annealed steel sheet is subjected to a coating treatment after the annealing process.

[9] The method for manufacturing a high-strength steel sheet according to item [8], wherein the coating treatment is a galvanizing treatment or a galvannealing treatment.

The high-strength steel sheet according to aspects of the present invention has yield strength of 550 MPa or more and is excellent in terms of high-speed torsional strength in a joint formed by performing resistance spot welding.

BRIEF DESCRIPTION OF THE DRAWINGS

The FIGURE is a schematic diagram illustrating a method for performing a torsion test under the condition of high-speed deformation.

DETAILED DESCRIPTION OF EMBODIMENTS OF THE INVENTION

Hereafter, the embodiment of the present invention will be described. Here, the present invention is not limited to the embodiment described below.

The high-strength steel sheet according to aspects of the present invention has a chemical composition containing, by mass %, C: 0.05% to 0.15%, Si: 0.010% to 1.80%, Mn: 1.8% to 3.2%, P: 0.05% or less, S: 0.02% or less, Al: 0.01% to 2.0%, one or more of B: 0.0001% to 0.005%, Ti: 0.005% to 0.04%, and Mo: 0.03% to 0.50%, and the balance being Fe and inevitable impurities.

In addition, the chemical composition described above may further contain, by mass %, Cr: 1.0% or less.

In addition, the chemical composition described above may further contain, by mass %, one or more of Cu, Ni, Sn, As, Sb, Ca, Mg, Pb, Co, Ta, W, REM, Zn, Nb, V, Cs, and Hf in a total amount of 1% or less.

Hereafter, the constituents of the chemical composition according to aspects of the present invention will be described. "%" representing the contents of the constituents refers to "mass %".

C: 0.05% to 0.15%

C is an element which is necessary to increase strength by forming martensite. In the case where the C content is less than 0.05%, since the effect of increasing strength caused by martensite is insufficient, it is not possible to achieve yield strength of 550 MPa or more. On the other hand, in the case where the C content is more than 0.15%, since a large amount of cementite is formed in a heat-affected zone, there is a decrease in toughness in a portion of the heat-affected zone where martensite is formed, which results in a decrease in strength in a torsion test under the condition of high-speed deformation. Therefore, the C content is set to be 0.05% to 0.15%. It is preferable that the lower limit of the C content be 0.06% or more, more preferably 0.07% or more, or even more preferably 0.08% or more. It is preferable that the upper limit of the C content be 0.12% or less, more preferably 0.11% or less, or even more preferably 0.10% or less.

Si: 0.010% to 1.80%

Si is an element which has a function of increasing the strength of a steel sheet through solid-solution strengthening. It is necessary that the Si content be 0.010% or more to stably achieve satisfactory yield strength. On the other hand, in the case where the Si content is more than 1.80%, since cementite is finely precipitated in martensite, there is a decrease in torsional strength under the condition of high-speed deformation. In addition, the upper limit of the Si content is set to be 1.80% to inhibit a crack from being generated in a heat-affected zone. It is preferable that the lower limit of the Si content be 0.50% or more, more preferably 0.80% or more, or even more preferably 1.00% or more. It is preferable that the upper limit of the Si content be 1.70% or less, more preferably 1.60% or less, or even more preferably 1.50% or less.

Mn: 1.8% to 3.2%

Mn is an element which has a function of increasing the strength of a steel sheet through solid-solution strengthening. Mn is an element which increases the strength of a material by forming martensite as a result of inhibiting, for example, ferrite transformation and bainite transformation. It is necessary that the Mn content be 1.8% or more, preferably 2.0% or more, or more preferably 2.1% or more to stably achieve satisfactory yield strength. On the other hand, in the case where the Mn content is large, cementite is formed when tempering is performed, and there is a decrease in toughness in a heat-affected zone, which results in a decrease in torsional strength under the condition of high-speed deformation. Therefore, the Mn content is set to be 3.2% or less. It is preferable that the upper limit of the Mn content be 2.8% or less or more preferably 2.6% or less.

P: 0.05% or Less

P decreases toughness as a result of being segregated at grain boundaries. Therefore, the P content is set to be 0.05% or less, preferably 0.03% or less, or more preferably 0.02% or less. Here, although it is preferable that the P content is as small as possible and it is possible to realize the effects according to aspects of the present invention with no P content, it is preferable that the P content be 0.0001% or more in consideration of manufacturing costs.

S: 0.02% or Less

S decreases toughness by combining with Mn to form coarse MnS grains. Therefore, it is preferable that the S content be decreased. In accordance with aspects of the present invention, the S content should be 0.02% or less, preferably 0.01% or less, or more preferably 0.002% or less. Here, although it is preferable that the S content is as small as possible and it is possible to realize the effects according to aspects of the present invention with no S content, it is preferable that the S content be 0.0001% or more in consideration of manufacturing costs.

Al: 0.01% to 2.0%

Since there is a decrease in toughness in the case where large amounts of oxides exist in steel, deoxidation is important. In addition, Al is effective for inhibiting the precipitation of cementite, and it is necessary that the Al content be 0.01% or more to realize such an effect. On the other hand, in the case where the Al content is more than 2.0%, since oxides and nitrides coagulate and are coarsened, there is a decrease in toughness. Therefore, the Al content is set to be 2.0% or less. It is preferable that the lower limit of the Al content be 0.02% or more or more preferably 0.03% or more. It is preferable that the upper limit of the Al content be 0.1% or less or more preferably 0.08% or less.

As described above, the chemical composition described above contains one or more of B: 0.0001% to 0.005%, Ti: 0.005% to 0.04%, and Mo: 0.03% to 0.50%.

B: 0.0001% to 0.005%

B is an element which is necessary to increase toughness by strengthening grain boundaries. It is necessary that the B content be 0.0001% or more to realize such an effect. On the other hand, in the case where the B content is more than 0.005%, B decreases toughness by forming $Fe_{23}(CB)_6$. Therefore, the B content is limited to be in a range of 0.0001% to 0.005%. It is preferable that the lower limit of the B content be 0.0010% or more or more preferably 0.0012% or more. It is preferable that the upper limit of the B content be 0.004% or less.

Ti: 0.005% to 0.04%

Ti brings out an effect of B by inhibiting the formation of BN as a result of combining with N to form nitrides, and Ti increases toughness by decreasing the diameter of crystal grains as a result of forming TiN. It is necessary that the Ti content be 0.005% or more to realize such effects. On the other hand, in the case where the Ti content is more than 0.04%, such effects become saturated, and it is difficult to stably manufacture a steel sheet due to an increase in rolling load. Therefore, the Ti content is limited to be in a range of 0.005% to 0.04%. It is preferable that the lower limit of the Ti content be 0.010% or more or more preferably 0.015% or more. It is preferable that the upper limit of the Ti content be 0.03% or less.

Mo: 0.03% to 0.50%

Mo is an element which further increases the effects according to aspects of the present invention. Mo decreases the grain diameter of martensite by promoting the nucleation of austenite. In addition, Mo increases the toughness of a heat-affected zone by preventing the formation of cementite and coarsening of crystal grains in the heat-affected zone. It is necessary that the Mo content be 0.03% or more. On the other hand, in the case where the Mo content is more than 0.50%, since Mo carbides are precipitated, there is conversely a decrease in toughness. Therefore, the Mo content is limited to be in a range of 0.03% to 0.50%. In addition, by controlling the Mo content to be within the range described above, since it is also possible to inhibit lowering of the liquid-metal embrittlement of a welded joint, it is possible to increase the strength of the joint. It is preferable that the lower limit of the Mo content be 0.08% or more or more preferably 0.09% or more. It is preferable that the upper limit of the Mo content be 0.40% or less or more preferably 0.30% or less.

As described above, the chemical composition according to aspects of the present invention may contain the elements below as optional constituents.

Cr: 1.0% or Less

Cr is an element which is effective for inhibiting temper embrittlement. Therefore, the addition of Cr further increases the effects according to aspects of the present invention. However, in the case where the Cr content is more than 1.0%, since Cr carbides are formed, there is a decrease in the toughness of a heat-affected zone.

In addition, one or more of Cu, Ni, Sn, As, Sb, Ca, Mg, Pb, Co, Ta, W, REM, Zn, Nb, V, Cs, and Hf may be added in a total amount of 1% or less, preferably 0.1% or less, or even more preferably 0.03% or less. Here, although there is no particular limitation on the lower limit of the total amount described above, it is preferable that the lower limit be 0.0001% or more.

In addition, the constituents other than those described above are Fe and inevitable impurities.

The remainder is Fe and inevitable impurities. In the case where, for example, the N content is 0.0040% or less, the B content is less than 0.0001%, the Ti content is less than 0.005%, or the Mo content is less than 0.03%, such an element is regarded as being contained as an inevitable impurity.

Although the chemical composition is described above, controlling only the chemical composition to be within the range described above is not sufficient for realizing the intended effects according to aspects of the present invention, that is, controlling a steel microstructure (microstructure) is also important. The conditions applied for controlling the microstructure will be described hereafter. Here, the microstructure described below is that which is viewed in a cross section in the thickness direction perpendicular to the rolling direction.

Volume Fraction of Martensite Phase: 50% to 80%

A martensite phase is a hard phase and has a function of increasing the strength of a steel sheet through transformation microstructure strengthening. In addition, it is necessary that the volume fraction of a martensite phase be 50% or more, preferably 55% or more, or more preferably 60% or more to achieve yield strength of 550 MPa or more. On the other hand, in the case where the volume fraction is more than 80%, since voids generated at the interface between a martensite phase and other phases are locally concentrated, there is a decrease in the toughness of a heat-affected zone. Therefore, the volume fraction of a martensite phase is set to be 50% to 80%. It is preferable that the upper limit of the volume fraction of a martensite phase is 70% or less or more preferably 65% or less.

Average Grain Diameter of Martensite Phase: 2 μm to 8 μm

It is preferable that the average grain diameter of a martensite phase be 2 μm or more or more preferably 5 μm or more to further increase yield strength. On the other hand, by controlling the average grain diameter of a martensite phase to be 8 μm or less, preferably 6 μm or less, since there is a further increase in the toughness of a heat-affected zone, there is a further increase in torsional strength under the condition of high-speed deformation.

The steel microstructure according to aspects of the present invention includes a ferrite phase in addition to a martensite phase. It is preferable that the volume fraction of a ferrite phase be 25% or more, more preferably 30% or more, or even more preferably 31% or more to increase the toughness of a heat-affected zone by inhibiting voids from being locally concentrated in the vicinity of martensite. In addition, it is preferable that the volume fraction be 50% or less, more preferably 49% or less, or even more preferably 45% or less to achieve satisfactory yield strength.

In addition, other phases such as cementite, pearlite, a bainite phase, and a retained austenite phase may be included in addition to a martensite phase and a ferrite phase. The total volume fraction of such other phases may be 8% or less.

Average Grain Diameter of Ferrite Phase: 13 μm or Less

In the case where the average grain diameter of a ferrite phase is more than 13 μm, there is a decrease in the strength of a steel sheet, and there is a decrease in toughness due to low-toughness ferrite which has been subjected to aging caused by a thermal influence. In addition, there is a decrease in the strength of a weld zone due to grain growth in a heat-affected zone (HAZ). Therefore, the average grain diameter of a ferrite phase is set to be 13 μm or less. Since there is a decrease in ductility in the case where there is a decrease in grain diameter, it is preferable that the lower limit of the average grain diameter is 3 μm or more, more preferably 5 μm or more, even more preferably 7 μm or more, or most preferably 8 μm or more. It is preferable that the upper limit of the average grain diameter be 12 μm or less.

Here, the above-described average grain diameter of a ferrite phase was determined by etching a portion located at ¼ of the thickness from the surface in a cross section (C-cross section) perpendicular to the rolling direction with a 1% nital solution to expose the microstructure, by taking photographs in 10 fields of view by using a scanning electron microscope (SEM) at a magnification of 1000 times, and by using a cutting method in accordance with ASTM E 112-10.

Volume Fraction of Ferrite Grains Having an Aspect Ratio of 2.0 or Less with Respect to Whole Ferrite Phase: 70% or More In the case where the aspect ratios of a large number of ferrite grains are more than 2.0, because the grain growth in the thickness direction is stopped by the pinning effect of precipitates, the grains are flattened through thermal influence, which results in a decrease in toughness. Here, the lower limit of the aspect ratio of ferrite grains formed in accordance with aspects of the present invention is substantially 0.8. In accordance with aspects of the present invention, the volume fraction of ferrite grains having an aspect ratio of 2.0 or less with respect to the whole ferrite phase is set to be 70% or more, or preferably 75% or more to increase toughness. It is preferable that the upper limit of the volume fraction is 90% or less or more preferably 85% or less.

The aspect ratios of ferrite grains were determined by etching a portion located at ¼ of the thickness from the surface in a cross section (C-cross section) perpendicular to the rolling direction with a 1% nital solution to expose the microstructure, by taking photographs in 10 fields of view by using a scanning electron microscope (SEM) at a magnification of 1000 times, and by calculating the ratio of the length in the width direction (C-direction) to the length in the thickness direction as an aspect ratio.

Average Length in the Longitudinal Direction of Ferrite Grains: 20 μm or Less

In the case where the average length in the longitudinal direction of ferrite grains is more than 20 μm, since the tip of an elongated ferrite grain, at which stress is concentrated, becomes a starting point at which a crack is generated in a heat-affected zone, there is a decrease in torsional strength under the condition of high-speed deformation. Therefore, the average length in the longitudinal direction of ferrite grains is set to be 20 μm or less, preferably 18 μm or less, or more preferably 16 μm or less. Although there is no particular limitation on the lower limit of the average length, it is preferable that the lower limit be 5 μm or more, more preferably 8 μm or more, or even more preferably 10 μm or more.

The high-strength steel sheet according to aspects of the present invention having the chemical composition and the microstructure described above may be a high-strength steel sheet having a coating layer on a surface thereof. It is preferable that the coating layer be a zinc coating layer or more preferably a galvanizing layer or a galvannealing layer. Here, the coating layer may be composed of a metal other than zinc.

Hereafter, the method for manufacturing the hot-rolled steel sheet according to aspects of the present invention will be described.

Hereafter, the method for manufacturing the high-strength steel sheet according to aspects of the present invention will be described. The method for manufacturing the high-strength steel sheet according to aspects of the present invention includes a hot-rolling process, a cold-rolling process, and an annealing process and may further include a coating process as needed. Hereafter, these processes will be described.

The hot-rolling process is a process in which a steel slab having the chemical composition is hot-rolled, in which the hot-rolled steel sheet is cooled at an average cooling rate of 10° C./s to 30° C./s, and in which the cooled steel sheet is coiled at a coiling temperature of 470° C. to 700° C.

In accordance with aspects of the present invention, there is no particular limitation on the method used for preparing molten steel for a steel material (steel slab), and a known method such as one which utilizes a converter or an electric furnace may be used. In addition, after having prepared molten steel, although it is preferable that a steel slab be manufactured by using a continuous casting method from a viewpoint of problems such as segregation, a slab may be manufactured by using a known casting method such as an ingot casting-slabbing method or a thin-slab continuous casting method. Here, when hot-rolling is performed on the cast slab, rolling may be performed after the slab has been reheated in a heating furnace, or hot direct rolling may be performed without heating the slab in the case where the slab has a temperature equal to or higher than a predetermined temperature.

The steel material described above is subjected to hot-rolling which includes rough rolling and finish rolling. In accordance with aspects of the present invention, it is preferable that carbides in the steel material are dissolved before rough rolling is performed. In the case where the slab is heated, it is preferable that the slab be heated to a temperature of 1100° C. or higher to dissolve carbides and to prevent an increase in rolling load. In addition, it is preferable that the slab heating temperature be 1300° C. or lower to prevent an increase in the amount of scale loss. In addition, as described above, in the case where the steel material which has yet to be subjected to rough rolling has a temperature equal to or higher than a predetermined temperature and where carbides in the steel material are dissolved, a process in which the steel material which has yet to be subjected to rough rolling is heated may be omitted. Here, it is not necessary to put a particular limitation on the conditions applied for rough rolling and finish rolling.

Average Cooling Rate of Cooling after Hot-Rolling: 10° C./s to 30° C./s

After hot-rolling has been performed, in the case where the average cooling rate to a coiling temperature is less than 10° C./s, since ferrite grains do not grow, the aspect ratio tends to be more than 2.0 such that there is a decrease in "the volume fraction of ferrite grains having an aspect ratio of 2.0 or less with respect to the whole ferrite phase" described above, which results in a decrease in the toughness of a heat-affected zone. On the other hand, in the case where the average cooling rate is more than 30° C./s, since ferrite grains grow excessively, there is a decrease in strength. Therefore, the average cooling rate is set to be 10° C./s to 30° C./s. It is preferable that the lower limit of the above-described average cooling rate be 15° C./s or more. It is preferable that the upper limit of the above-described average cooling rate be 25° C./s or less. Here, it is preferable that a cooling start temperature, that is, a finish rolling temperature, be 850° C. to 980° C., because this results in ferrite grains in the hot-rolled steel sheet growing uniformly and having the desired aspect ratio.

Coiling Temperature: 470° C. to 700° C.

In the case where the coiling temperature is lower than 470° C., since low-temperature-transformation phases such as bainite are formed, softening occurs in a heat-affected zone. On the other hand, in the case where the coiling temperature is higher than 700° C., since there is an excessive coarsening in ferrite grain diameter, there is a decrease in the toughness of a heat-affected zone. Therefore, the coiling temperature is set to be 470° C. to 700° C. It is preferable that the lower limit of the coiling temperature be 500° C. or higher. It is preferable that the upper limit of the coiling temperature be 600° C. or lower.

In the cold-rolling process, cold-rolling is performed on the hot-rolled steel sheet obtained in the hot-rolling process described above. Although there is no particular limitation on the rolling reduction ratio of cold-rolling, the rolling reduction ratio is usually 30% to 60%. Here, cold-rolling may be performed after pickling has been performed, and, in this case, there is no particular limitation on the conditions applied for pickling.

An annealing process is performed after the cold-rolling process described above. Specific conditions applied for the annealing process are as follows.

Annealing Condition: Holding at an Annealing Temperature of 750° C. to 900° C. for 30 Seconds to 200 Seconds It is necessary that annealing be performed by holding the cold-rolled steel sheet at an annealing temperature of 750° C. to 900° C. for 30 seconds to 200 seconds to form a microstructure in which the average grain diameter of the ferrite phase is 13 μm or less and in which the volume fraction of ferrite grains having an aspect ratio of 2.0 or less with respect to the whole ferrite phase is 70% or more. In the case where the annealing temperature is lower than 750° C. or the holding time is less than 30 seconds, since the progress of recovery is delayed, it is not possible to achieve the desired aspect ratio. On the other hand, in the case where the annealing temperature is higher than 900° C., since there is an increase in the volume fraction of martensite, there is a decrease in the toughness of a heat-affected zone. In addition, in the case where the annealing time is more than 200 seconds, there may be a decrease in ductility due to a large amount of iron carbides being precipitated in some cases. Therefore, the annealing temperature is set to be 750° C. to 900° C. or preferably 800° C. to 900° C. In addition, the holding time is set to be 30 seconds to 200 seconds or preferably 50 seconds to 150 seconds. Here, there is no particular limitation on the conditions applied for heating to the annealing temperature range described above.

Reverse Bending Through Rolls Having a Radius of 200 mm or More: Eight Times or More in Total In the case where a large number of ferrite grains have an aspect ratio of more than 2.0 such that "the volume fraction of ferrite grains having an aspect ratio of 2.0 or less with respect to the whole ferrite phase" described above is out of the desired range, there is a decrease in toughness. To control "the volume fraction of ferrite grains having an aspect ratio of 2.0 or less with respect to the whole ferrite phase" described above to be within the desired range, it is necessary to grow the grains during annealing. For this purpose, in the holding in the annealing temperature range described above, it is necessary to perform reverse bending through rolls having a radius of 200 mm or more eight times or more. It is considered that, in the case where rolls having a radius of less than 200 mm are used, since there is an increase in the amount of bending strain, there is an increase in the amount of elongation of a steel sheet, which results in a tendency for ferrite grains to have an aspect ratio of more than 2.0. Therefore, the radius of the rolls is set to be 200 mm or more. Although there is no particular limitation on the upper limit of the roll radius, it is preferable that the upper limit be 1400 mm or less or more preferably 900 mm or less. In addition, in the case where the number of times of reverse bending is less than 8, ferrite grains tend to have an aspect ratio of more than 2.0. Therefore, the number of times of reverse bending is set to be 8 or more or preferably 9 or more. Here, in the case where there is an increase in the amount of bending strain, there is a decrease in the toughness of a heat-affected zone. Therefore, it is preferable that the number of times of reverse bending be 15 or less. Here, the expression "the number of times of reverse bending is 8 or more in total" refers to a case where the sum of the number of times of bending and the number of times of unbending is 8 or more. Now, the term "reverse bending" means "bending in one direction, and bending in the opposite direction repeatedly".

Average Cooling Rate of Cooling after Holding in the Annealing Temperature Range: 10° C./s or More In the case where the average cooling rate is less than 10° C./s, since ferrite grains are coarsened, there is a decrease in strength and the toughness of a heat-affected zone. Therefore, the average cooling rate is set to be 10° C./s or more. In the case where the cooling rate is excessively increased, it is not possible to achieve the desired aspect ratio. Therefore, it is preferable that the average cooling rate be 30° C./s or less.

Cooling Stop Temperature of Cooling after Holding in the Annealing Temperature Range: 400° C. to 600° C.

In the case where the cooling stop temperature is lower than 400° C., since it is not possible to achieve the desired volume fraction of a martensite phase, there is a decrease in strength. On the other hand, in the case where the cooling stop temperature is higher than 600° C., since ferrite grains grow, there is a decrease in strength and the toughness of a heat-affected zone. Therefore, the cooling stop temperature described above is set to be 400° C. to 600° C.

A coating process in which a coating treatment is performed may be performed after the annealing process described above has been performed. There is no particular limitation on the kind of the coating treatment, and an electroplating treatment or a hot-dip plating treatment may be performed. An alloying treatment may be performed after a hot-dip plating treatment has been performed.

Here, the steel microstructure (microstructure) of the high-strength steel sheet according to aspects of the present invention is controlled by the manufacturing conditions. Therefore, an integrated combination of the hot-rolling process, the cold-rolling process, and the annealing process described above is effective for controlling the steel microstructure of the high-strength steel sheet according to aspects of the present invention.

EXAMPLES

Steel sheets were manufactured by performing a hot-rolling process, a cold-rolling process, and an annealing process on slabs having the chemical compositions given in Table 1 under the conditions given in Table 2. The methods used for investigations were as follows.

TABLE 1

| Steel | Chemical Composition (mass %) | | | | | | | | | |
|---|---|---|---|---|---|---|---|---|---|---|
| Code | C | Si | Mn | P | S | Al | B | Ti | Mo | Other |
| A | 0.072 | 1.52 | 2.5 | 0.02 | 0.01 | 0.03 | 0.002 | 0.02 | 0.15 | — |
| B | 0.068 | 1.49 | 2.1 | 0.01 | 0.01 | 0.04 | 0.002 | — | 0.12 | Ni: 0.10, Cu: 0.07 |
| C | 0.062 | 1.20 | 2.3 | 0.01 | 0.02 | 0.05 | — | 0.03 | 0.15 | Nb: 0.005, V: 0.003 |
| D | 0.041 | 1.15 | 2.3 | 0.01 | 0.02 | 0.06 | 0.001 | 0.02 | 0.21 | — |
| E | 0.086 | 1.54 | 2.2 | 0.02 | 0.01 | 0.05 | 0.002 | 0.02 | 0.10 | Cr: 0.35 |
| F | 0.078 | 1.10 | 2.1 | 0.02 | 0.01 | 0.04 | 0.001 | 0.01 | 0.06 | — |
| G | 0.058 | 1.69 | 2.8 | 0.02 | 0.02 | 0.04 | 0.003 | 0.01 | 0.18 | Cr: 0.01, Sn: 0.007 |
| H | 0.093 | 0.92 | 2.3 | 0.01 | 0.01 | 0.03 | 0.002 | 0.01 | 0.05 | — |
| I | 0.084 | 1.58 | 2.2 | 0.01 | 0.02 | 0.06 | 0.003 | 0.03 | 0.26 | Mg: 0.002, Ta: 0.020 |

TABLE 1-continued

| Steel Code | Chemical Composition (mass %) C | Si | Mn | P | S | Al | B | Ti | Mo | Other |
|---|---|---|---|---|---|---|---|---|---|---|
| J | 0.172 | 1.06 | 2.4 | 0.01 | 0.02 | 0.03 | 0.004 | 0.02 | 0.04 | — |
| K | 0.074 | 1.42 | 1.6 | 0.02 | 0.02 | 0.05 | 0.002 | 0.01 | 0.10 | — |
| L | 0.082 | 1.28 | 2.4 | 0.02 | 0.02 | 0.03 | 0.001 | 0.02 | — | Pb: 0.007, Ta: 0.004 |
| M | 0.092 | 1.92 | 2.8 | 0.01 | 0.02 | 0.03 | 0.003 | 0.02 | — | — |
| N | 0.081 | 0.005 | 2.1 | 0.01 | 0.01 | 1.82 | 0.001 | 0.03 | 0.15 | — |
| O | 0.059 | 1.60 | 2.5 | 0.02 | 0.02 | 0.06 | 0.004 | 0.02 | 0.35 | Cs: 0.005, Hf: 0.004 |
| P | 0.065 | 1.26 | 3.4 | 0.01 | 0.01 | 0.04 | 0.001 | 0.02 | 0.21 | — |
| Q | 0.072 | 1.59 | 2.3 | 0.01 | 0.02 | 0.05 | 0.005 | 0.02 | 0.22 | As: 0.005, Sb: 0.01 |
| R | 0.081 | 1.46 | 2.1 | 0.02 | 0.01 | 0.04 | 0.004 | 0.03 | 0.14 | Co: 0.009 |
| S | 0.093 | 1.23 | 2.0 | 0.01 | 0.02 | 0.06 | 0.002 | 0.01 | 0.05 | REM: 0.20 |
| T | 0.110 | 0.26 | 1.9 | 0.01 | 0.02 | 1.25 | 0.005 | 0.02 | — | Zn: 0.08, V: 0.05 |
| U | 0.077 | 1.61 | 2.5 | 0.02 | 0.01 | 0.09 | 0.001 | 0.03 | 0.06 | W: 0.004 |
| V | 0.076 | 1.72 | 2.8 | 0.02 | 0.01 | 0.07 | 0.004 | 0.03 | 0.38 | Ca: 0.0040 |
| W | 0.075 | 1.51 | 3.0 | 0.01 | 0.02 | 0.06 | 0.005 | 0.03 | — | — |
| X | 0.073 | 1.46 | 2.5 | 0.02 | 0.02 | 0.05 | 0.0006 | — | — | — |
| Y | 0.081 | 1.53 | 2.3 | 0.02 | 0.01 | 0.05 | — | 0.007 | — | — |
| Z | 0.086 | 1.62 | 2.7 | 0.01 | 0.02 | 0.04 | — | — | 0.05 | — |
| 1 | 0.085 | 1.52 | 2.2 | 0.02 | 0.002 | 0.03 | 0.001 | 0.02 | 0.12 | — |
| 2 | 0.082 | 1.48 | 2.4 | 0.01 | 0.001 | 0.03 | 0.002 | 0.02 | 0.11 | — |
| 3 | 0.089 | 1.51 | 2.3 | 0.01 | 0.002 | 0.03 | 0.001 | 0.01 | 0.15 | — |
| 4 | 0.081 | 1.53 | 2.3 | 0.02 | 0.002 | 0.04 | 0.003 | 0.01 | 0.13 | — |
| 5 | 0.078 | 1.56 | 2.5 | 0.01 | 0.001 | 0.05 | 0.002 | 0.02 | 0.19 | — |
| 6 | 0.082 | 1.59 | 2.6 | 0.01 | 0.001 | 0.04 | 0.001 | 0.01 | 0.12 | — |
| 7 | 0.087 | 0.72 | 2.1 | 0.01 | 0.002 | 0.03 | 0.002 | 0.02 | 0.09 | — |
| 8 | 0.086 | 0.65 | 2.2 | 0.01 | 0.002 | 0.04 | 0.001 | 0.01 | 0.07 | — |
| 9 | 0.081 | 0.61 | 2.4 | 0.01 | 0.002 | 0.04 | 0.001 | 0.01 | 0.10 | — |

* Underlined portions indicate items out of the scope of the present invention.

TABLE 2

| No. | Steel Code | Hot-rolling: Slab Heating Temperature (° C.) | Finish Rolling Temperature (° C.) | Average Cooling Rate (° C./s)*1 | Coiling Temperature (° C.) | Cold-rolling: Cold-rolling Reduction Ratio (%) | Annealing: Annealing Temperature (° C.) | Holding Time (s) | Number of Times of Reverse bending through Roll Having a Radius of 200 mm or More | Average Cooling Rate (° C./s)*2 | Cooling Stop Temperature (° C.) | Note |
|---|---|---|---|---|---|---|---|---|---|---|---|---|
| 1 | A | 1250 | 910 | 22 | 520 | 42 | 800 | 70 | 12 | 15 | 520 | Example Steel |
| 2 | A | 1250 | 890 | 20 | 500 | 42 | 820 | 85 | 13 | 16 | 510 | Example Steel |
| 3 | B | 1250 | 900 | 20 | 510 | 45 | 810 | 72 | 13 | 14 | 500 | Example Steel |
| 4 | B | 1250 | 910 | 21 | 520 | 45 | 820 | 71 | 7 | 15 | 480 | Comparative Steel |
| 5 | C | 1250 | 910 | 26 | 530 | 35 | 800 | 20 | 12 | 15 | 490 | Comparative Steel |
| 6 | C | 1250 | 890 | 28 | 520 | 38 | 810 | 85 | 13 | 12 | 480 | Example Steel |
| 7 | C | 1250 | 900 | 28 | 520 | 38 | 810 | 85 | 12 | 7 | 480 | Comparative Steel |
| 8 | D | 1250 | 890 | 27 | 520 | 38 | 810 | 80 | 12 | 12 | 480 | Comparative Steel |
| 9 | E | 1250 | 900. | 20 | 510 | 40 | 790 | 68 | 12 | 20 | 500 | Example Steel |
| 10 | F | 1250 | 890 | 15 | 490 | 40 | 810 | 90 | 13 | 15 | 540 | Example Steel |
| 11 | F | 1250 | 880 | 8 | 480 | 40 | 790 | 65 | 11 | 16 | 540 | Comparative Steel |
| 12 | F | 1250 | 890 | 40 | 480 | 40 | 790 | 65 | 12 | 14 | 540 | Comparative Steel |
| 13 | G | 1250 | 900 | 24 | 590 | 52 | 850 | 46 | 13 | 15 | 520 | Example Steel |
| 14 | G | 1250 | 910 | 26 | 730 | 52 | 820 | 140 | 12 | 14 | 520 | Comparative Steel |
| 15 | G | 1250 | 920 | 24 | 600 | 52 | 730 | 60 | 11 | 15 | 530 | Comparative Steel |
| 16 | H | 1250 | 900 | 23 | 500 | 48 | 800 | 75 | 6 | 13 | 480 | Comparative Steel |
| 17 | I | 1250 | 910 | 22 | 510 | 52 | 820 | 90 | 12 | 18 | 520 | Example Steel |
| 18 | J | 1250 | 900 | 23 | 520 | 36 | 810 | 70 | 13 | 15 | 480 | Comparative Steel |
| 19 | K | 1250 | 910 | 22 | 510 | 34 | 820 | 90 | 12 | 32 | 490 | Comparative Steel |

TABLE 2-continued

| No. | Steel Code | Hot-rolling: Slab Heating Temperature (° C.) | Hot-rolling: Finish Rolling Temperature (° C.) | Hot-rolling: Average Cooling Rate (° C./s)*1 | Hot-rolling: Coiling Temperature (° C.) | Cold-rolling: Cold-rolling Reduction Ratio (%) | Annealing: Annealing Temperature (° C.) | Annealing: Holding Time (s) | Annealing: Number of Times of Reverse bending through Roll Having a Radius of 200 mm or More | Annealing: Average Cooling Rate (° C./s)*2 | Annealing: Cooling Stop Temperature (° C.) | Note |
|---|---|---|---|---|---|---|---|---|---|---|---|---|
| 20 | L | 1250 | 890 | 25 | 520 | 50 | 810 | 85 | 13 | 16 | 520 | Example Steel |
| 21 | L | 1250 | 900 | 22 | 510 | 35 | 810 | 80 | 10 | 16 | 300 | Comparative Steel |
| 22 | L | 1250 | 910 | 24 | 510 | 38 | 820 | 75 | 10 | 17 | 620 | Comparative Steel |
| 23 | M | 1250 | 910 | 23 | 490 | 39 | 820 | 84 | 9 | 17 | 520 | Comparative Steel |
| 24 | N | 1250 | 890 | 24 | 510 | 38 | 800 | 79 | 10 | 16 | 510 | Comparative Steel |
| 25 | 0 | 1250 | 900 | 23 | 510 | 40 | 810 | 78 | 10 | 18 | 520 | Example Steel |
| 26 | P | 1250 | 900 | 26 | 500 | 45 | 800 | 80 | 10 | 16 | 530 | Comparative Steel |
| 27 | Q | 1250 | 910 | 25 | 500 | 40 | 810 | 80 | 9 | 15 | 510 | Example Steel |
| 28 | R | 1250 | 920 | 24 | 480 | 40 | 820 | 85 | 10 | 16 | 490 | Example Steel |
| 29 | S | 1250 | 900 | 24 | 490 | 38 | 820 | 83 | 10 | 17 | 500 | Example Steel |
| 30 | T | 1250 | 900 | 25 | 500 | 39 | 810 | 80 | 10 | 19 | 480 | Example Steel |
| 31 | U | 1250 | 910 | 25 | 490 | 38 | 810 | 82 | 10 | 18 | 490 | Example Steel |
| 32 | V | 1250 | 890 | 25 | 500 | 40 | 810 | 80 | 10 | 18 | 480 | Example Steel |
| 33 | W | 1250 | 900 | 25 | 500 | 50 | 810 | 80 | 10 | 16 | 480 | Example Steel |
| 34 | X | 1250 | 920 | 24 | 480 | 52 | 820 | 85 | 10 | 15 | 490 | Example Steel |
| 35 | Y | 1250 | 910 | 24 | 490 | 58 | 820 | 83 | 10 | 13 | 500 | Example Steel |
| 36 | Z | 1250 | 910 | 25 | 490 | 42 | 810 | 82 | 10 | 18 | 490 | Example Steel |
| 37 | 1 | 1250 | 910 | 25 | 520 | 52 | 820 | 80 | 9 | 18 | 500 | Example Steel |
| 38 | 1 | 1250 | 910 | 32 | 510 | 52 | 820 | 80 | 9 | 20 | 500 | Comparative Steel |
| 39 | 2 | 1250 | 910 | 25 | 500 | 52 | 820 | 80 | 9 | 18 | 500 | Example Steel |
| 40 | 3 | 1250 | 910 | 25 | 500 | 52 | 810 | 80 | 9 | 18 | 500 | Example Steel |
| 41 | 4 | 1250 | 910 | 25 | 510 | 52 | 830 | 80 | 9 | 18 | 500 | Example Steel |
| 42 | 5 | 1250 | 910 | 25 | 510 | 52 | 800 | 80 | 9 | 18 | 500 | Example Steel |
| 43 | 6 | 1250 | 910 | 25 | 520 | 52 | 810 | 80 | 9 | 18 | 500 | Example Steel |
| 44 | 7 | 1250 | 910 | 25 | 520 | 52 | 790 | 80 | 9 | 18 | 500 | Example Steel |
| 45 | 8 | 1250 | 910 | 25 | 520 | 52 | 800 | 80 | 9 | 18 | 500 | Example Steel |
| 46 | 9 | 1250 | 910 | 25 | 510 | 51 | 810 | 82 | 9 | 16 | 500 | Example Steel |

* Underlined portions indicate items out of the scope of the present invention.

*1average cooling rate to a coiling temperature after hot-rolling

*2average cooling rate of cooling after holding at the annealing temperature range (1) Microstructure Observation In this investigation, the area fraction of retained austenite was determined by using an X-ray diffractometer to distinguish between martensite and retained austenite. The determination method is as follows. The area fraction of retained austenite was defined as the ratio of the integrated reflection intensity from the planes of fcc-iron to the integrated reflection intensity from the planes of bcc-iron derived by polishing the surface of a steel sheet in the thickness direction to the position located at ¼ of the thickness, by further performing chemical polishing on the polished surface to remove a thickness of 0.1 mm, by determining, by using an X-ray diffractometer with the Kα-ray of Mo, the integrated reflection intensities from the (200)-plane, (220)-plane, and (311)-plane of fcc-iron and from the (200)-plane, (211)-plane, and (220)-plane of bcc-iron, and by calculating the ratio from the integrated intensities.

To determine the area fractions of ferrite and martensite, a cross section in the thickness direction perpendicular to the rolling direction of the obtained steel sheet was polished and etched with a 1% nital solution to expose a microstructure. By using a scanning electron microscope at a magnification of 1000 times, images were obtained in 10 fields of view in a region from the surface to a ¼t position. "t" denotes the thickness of a steel sheet, that is, a steel sheet thickness. The area fraction of each of the constituent phases was determined by using the images obtained as described above, and the determined area fraction was defined as the volume fraction of the constituent phase. A ferrite phase is a microstructure having a grain in which corrosion mark or iron-based carbide is not observed. A martensite phase is a microstructure having a grain which has a white appearance. In addition, a microstructure having a grain in which a large number of oriented fine iron-based carbides and corrosion marks are observed is also regarded as martensite. Since retained austenite has a white appearance, the area fraction of martensite was calculated by subtracting the area fraction of retained austenite, which was determined by using an X-ray diffractometer, from the area fraction of a phase which had a white appearance. The area fraction of a martensite phase described above was defined as the volume fraction of a martensite phase. Here, as other phases, a bainite phase, a pearlite phase, and retained austenite phase were observed.

The average grain diameter of a martensite phase and the average grain diameter of a ferrite phase were determined by using the above-described sample used for determining the volume fraction, by using a scanning electron microscope (SEM) at a magnification of 1000 times to obtain images in 10 fields of view, and by using a cutting method in accordance with ASTM E 112-10. The calculated average grain diameters of a martensite phase and a ferrite phase are given in Table 3.

The aspect ratio of ferrite grains was determined by using the above-described sample used for determining the volume fraction, by using a scanning electron microscope (SEM) at a magnification of 1000 times to obtain images of the exposed microstructure which was prepared by performing etching using a 1% nital solution in 10 fields of view, and by defining the ratio of the length in the width direction (C-direction) to the length in the thickness direction as an aspect ratio. The volume fraction of ferrite grains having an aspect ratio of 2.0 with respect to the whole ferrite phase was calculated by calculating the total volume fraction of ferrite grains having an aspect ratio of 2.0 and by using the volume fraction of a ferrite phase determined as described above.

In addition, the average length in the longitudinal direction of ferrite grains was determined by calculating the average values of the length in the width direction of the ferrite grains on the basis of the images used for determining the aspect ratio.

(2) Tensile Property

By performing a tensile test five times in accordance with JIS Z 2241 on a JIS No. 5 tensile test piece in accordance with JIS Z 2201 whose longitudinal direction (tensile direction) was a direction perpendicular to the rolling direction, average yield strength (YP), tensile strength (TS), and butt elongation (EL) were determined. The results are given in Table 3.

(3) Torsion Test Under Condition of High-Speed Deformation

A test piece was prepared by overlapping two steel sheets, across the full width thereof as illustrated in FIG. 1(*a*), which had a width of 10 mm, a length of 80 mm, a thickness of 1.6 mm and whose longitudinal direction was a direction perpendicular to the rolling direction and by performing spot welding so that the nugget diameter was 7 mm. The prepared test piece was vertically fixed to a dedicated die as illustrated in FIG. 1(*b*) and applied with a test force of a forming load of 10 kN at a loading speed of 100 mm/min with a pressing metallic tool so as to be deformed so that an angle of 170° was made as illustrated in FIG. 1(*c*). Subsequently, to determine whether a crack existed in the weld zone, a cross section in the thickness direction in the rolling direction was subjected to mirror polishing without etching and magnified by using an optical microscope at a magnification of 400 times to observe a crack (FIG. 1(*d*)). A case where no crack was generated was determined as "⊙", a case where a crack having a length of 50 μm or less was generated was determined as "○", a case where a crack having a length of more than 50 μm and less than 100 μm was generated was determined as "Δ", and a case where a crack having a length of 100 μm or more was generated was determined as "x". These results are collectively given in Table 3. Here, in the test, a case determined as "⊙" or "○" was regarded as a case of excellent weldability, high torsional strength under the condition of high-speed deformation, and excellent toughness.

TABLE 3

| | Characteristics of Steel Sheet Microstructure | | | | | | | | | | |
|---|---|---|---|---|---|---|---|---|---|---|---|
| | Martensite Microstructure | | Ferrite Microstructure | | | | | | | | |
| | Volume Fraction of Martensite | Average Grain Diameter | Volume Fraction of Ferrite | Average Grain Diameter | Average Length in Longitudinal Direction of Ferrite Grain | Volume Fraction of Ferrite Grain Having Aspect Ratio of 2.0 or Less | Steel Sheet Property | | | Crack Generation in Weld | |
| No. | (%) | (μm) | (%) | (μm) | (μm) | (%) | YP(MPa) | TS(MPa) | EL(%) | Zone | Note |
| 1 | 59 | 5 | 38 | 10 | 11 | 79 | 610 | 1010 | 18.3 | ⊙ | Example Steel |
| 2 | 63 | 4 | 32 | 11 | 10 | 82 | 635 | 1030 | 18.0 | ⊙ | Example Steel |
| 3 | 59 | 4 | 36 | 12 | 13 | 71 | 630 | 1025 | 18.0 | ⊙ | Example Steel |
| 4 | 60 | 7 | 34 | 12 | 15 | 62 | 628 | 1038 | 17.8 | Δ | Comparative Steel |
| 5 | 65 | 6 | 30 | 14 | 17 | 56 | 640 | 1045 | 17.6 | X | Comparative Steel |
| 6 | 61 | 5 | 32 | 9 | 7 | 76 | 642 | 1050 | 17.6 | ⊙ | Example Steel |
| 7 | 50 | 4 | 44 | 15 | 17 | 68 | 610 | 1000 | 18.1 | X | Comparative Steel |
| 8 | 25 | 2 | 70 | 20 | 21 | 50 | 420 | 700 | 24.5 | X | Comparative Steel |
| 9 | 68 | 7 | 26 | 10 | 9 | 80 | 652 | 1060 | 17.5 | ○ | Example Steel |
| 10 | 72 | 6 | 25 | 10 | 9 | 82 | 628 | 1040 | 17.8 | ○ | Example Steel |
| 11 | 75 | 5 | 21 | 13 | 16 | 60 | 625 | 1020 | 18.1 | Δ | Comparative Steel |
| 12 | 45 | 4 | 50 | 16 | 14 | 72 | 530 | 960 | 19.3 | Δ | Comparative Steel |
| 13 | 56 | 5 | 40 | 12 | 13 | 73 | 605 | 1000 | 18.5 | ⊙ | Example Steel |
| 14 | 40 | 3 | 55 | 18 | 19 | 62 | 516 | 940 | 19.7 | Δ | Comparative Steel |
| 15 | 56 | 5 | 40 | 14 | 17 | 57 | 538 | 975 | 19.0 | X | Comparative Steel |
| 16 | 76 | 4 | 20 | 12 | 17 | 50 | 690 | 1080 | 17.1 | X | Comparative Steel |

TABLE 3-continued

| | Characteristics of Steel Sheet Microstructure | | | | | | | | | | |
|---|---|---|---|---|---|---|---|---|---|---|---|
| | | | Ferrite Microstructure | | | | | | | | |
| | Martensite Microstructure | | Volume | | Average Length in | Volume Fraction of Ferrite Grain Having | | | | | |
| No. | Volume Fraction of Martensite (%) | Average Grain Diameter (μm) | Fraction of Ferrite (%) | Average Grain Diameter (μm) | Longitudinal Direction of Ferrite Grain (μm) | Aspect Ratio of 2.0 or Less (%) | Steel Sheet Property YP(MPa) | TS(MPa) | EL(%) | Crack Generation in Weld Zone | Note |
| 17 | 68 | 5 | 25 | 11 | 12 | 70 | 650 | 1055 | 17.5 | ○ | Example Steel |
| 18 | 85 | 7 | 13 | 6 | 14 | 60 | 810 | 1180 | 11.2 | X | Comparative Steel |
| 19 | 45 | 5 | 54 | 12 | 13 | 75 | 530 | 925 | 20.0 | ○ | Comparative Steel |
| 20 | 55 | 6 | 38 | 13 | 14 | 71 | 560 | 982 | 18.8 | ⊙ | Example Steel |
| 21 | 42 | 5 | 55 | 12 | 14 | 72 | 540 | 976 | 19.0 | X | Comparative Steel |
| 22 | 41 | 6 | 54 | 16 | 15 | 77 | 530 | 960 | 19.3 | X | Comparative Steel |
| 23 | 82 | 4 | 16 | 9 | 10 | 80 | 700 | 1100 | 16.8 | Δ | Comparative Steel |
| 24 | 46 | 5 | 50 | 17 | 18 | 53 | 520 | 860 | 20.1 | X | Comparative Steel |
| 25 | 60 | 6 | 35 | 12 | 14 | 83 | 565 | 985 | 18.8 | ⊙ | Example Steel |
| 26 | 83 | 7 | 14 | 11 | 12 | 78 | 690 | 1150 | 16.5 | X | Comparative Steel |
| 27 | 60 | 6 | 34 | 12 | 14 | 83 | 630 | 1030 | 18.0 | ⊙ | Example Steel |
| 28 | 62 | 5 | 32 | 12 | 15 | 85 | 640 | 1035 | 17.9 | ⊙ | Example Steel |
| 29 | 63 | 6 | 30 | 13 | 13 | 84 | 635 | 1040 | 17.8 | ⊙ | Example Steel |
| 30 | 52 | 4 | 42 | 11 | 14 | 85 | 625 | 1020 | 18.1 | ○ | Example Steel |
| 31 | 62 | 5 | 35 | 12 | 13 | 85 | 640 | 1035 | 17.9 | ⊙ | Example Steel |
| 32 | 53 | 4 | 42 | 13 | 14 | 84 | 612 | 1020 | 17.8 | ○ | Example Steel |
| 33 | 65 | 6 | 30 | 13 | 15 | 75 | 640 | 1005 | 17.2 | ○ | Example Steel |
| 34 | 57 | 5 | 36 | 12 | 14 | 78 | 600 | 1000 | 18.5 | ○ | Example Steel |
| 35 | 60 | 6 | 32 | 11 | 10 | 84 | 645 | 1040 | 17.9 | ○ | Example Steel |
| 36 | 63 | 4 | 31 | 13 | 14 | 75 | 650 | 1025 | 18.1 | ○ | Example Steel |
| 37 | 65 | 6 | 30 | 11 | 12 | 80 | 655 | 1030 | 17.6 | ⊙ | Example Steel |
| 38 | 54 | 4 | 42 | 14 | 14 | 80 | 530 | 955 | 19.0 | X | Comparative Steel |
| 39 | 64 | 5 | 32 | 10 | 11 | 82 | 650 | 1020 | 18.2 | ⊙ | Example Steel |
| 40 | 63 | 6 | 31 | 11 | 12 | 83 | 640 | 1010 | 18.6 | ⊙ | Example Steel |
| 41 | 70 | 5 | 28 | 10 | 12 | 81 | 670 | 1070 | 17.1 | ⊙ | Example Steel |
| 42 | 58 | 4 | 35 | 10 | 12 | 84 | 580 | 995 | 18.5 | ⊙ | Example Steel |
| 43 | 60 | 5 | 36 | 11 | 12 | 80 | 630 | 1000 | 18.4 | ⊙ | Example Steel |
| 44 | 60 | 7 | 37 | 10 | 11 | 78 | 635 | 1015 | 17.9 | ⊙ | Example Steel |
| 45 | 62 | 8 | 35 | 10 | 11 | 76 | 640 | 1020 | 18.2 | ⊙ | Example Steel |
| 46 | 50 | 6 | 42 | 6 | 9 | 76 | 590 | 995 | 15.3 | ○ | Example Steel |

* Underlined portions indicate items out of the scope of the present invention.

The invention claimed is:

1. A high-strength steel sheet having:

a chemical composition containing, by mass %,

C: 0.05% to 0.15%,

Si: 0.010% to 1.80%,

Mn: 1.8% to 3.2%,

P: 0.05% or less,

S: 0.02% or less,

Al: 0.01% to 2.0%, one or more of B: 0.0001% to 0.005%, Ti: 0.005% to 0.04%, and Mo: 0.03% to 0.50%, and the balance being Fe and inevitable impurities, a microstructure, where observed in a cross section in a thickness direction perpendicular to a rolling direction, including a martensite phase having a volume fraction of 50% to 80%, and a ferrite phase having an average grain diameter of 3 μm or more and 13 μm or less, wherein a volume fraction of ferrite grains having an aspect ratio of length in a width direction of the steel sheet to length in a thickness direction of the steel sheet of 2.0 or less with respect to the whole ferrite phase is 70% or more, and wherein an average length in the width direction of the steel sheet of the ferrite grains is 20 μm or less, and a yield strength (YP) of 550 MPa or more.

2. The high-strength steel sheet according to claim 1, wherein the microstructure further includes an average grain diameter of the martensite phase being 2 μm to 8 μm where observed in a cross section in the thickness direction perpendicular to the rolling direction.

3. The high-strength steel sheet according to claim 1, wherein the chemical composition further contains, by mass %, at least one from one or more of groups A and B group A Cr: 1.0% or less.

group B one or more of Cu, Ni, Sn, As, Sb, Ca, Mg, Pb, Co, Ta, W, REM, Zn, Nb, V, Cs, and Hf of 1% or less in total.

4. The high-strength steel sheet according to claim 2, wherein the chemical composition further contains, by mass %, at least one from one or more of groups A and B group A Cr: 1.0% or less.

group B one or more of Cu, Ni, Sn, As, Sb, Ca, Mg, Pb, Co, Ta, W, REM, Zn, Nb, V, Cs, and Hf of 1% or less in total.

5. The high-strength steel sheet according to claim 1, the steel sheet further having a coating layer on a surface of the steel sheet.

6. The high-strength steel sheet according to claim 2, the steel sheet further having a coating layer on a surface of the steel sheet.

7. The high-strength steel sheet according to claim 3, the steel sheet further having a coating layer on a surface of the steel sheet.

8. The high-strength steel sheet according to claim 4, the steel sheet further having a coating layer on a surface of the steel sheet.

9. The high-strength steel sheet according to claim 5, wherein the coating layer is a galvanizing layer or a galvannealing layer.

10. The high-strength steel sheet according to claim 6, wherein the coating layer is a galvanizing layer or a galvannealing layer.

11. The high-strength steel sheet according to claim 7, wherein the coating layer is a galvanizing layer or a galvannealing layer.

12. The high-strength steel sheet according to claim 8, wherein the coating layer is a galvanizing layer or a galvannealing layer.

13. The high-strength steel sheet according to claim 1, wherein the average length in the width direction of the steel sheet of the ferrite grains is 10 μm or more and 20 μm or less.

14. A method for manufacturing the high-strength steel sheet according to claim 1, the method comprising a hot-rolling process including:

hot-rolling a steel slab having the chemical composition according to claim 1, cooling at an average cooling rate of 10° C./s to 30° C./s, and coiling at a coiling temperature of 470° C. to 700° C.;

a cold-rolling process in which the hot-rolled steel sheet obtained in the hot-rolling process is cold-rolled; and an annealing process including:

heating the cold-rolled steel sheet obtained in the cold-rolling process to an annealing temperature range of 750° C. to 900° C., holding the heated steel sheet at the annealing temperature range for 30 seconds to 200 seconds, wherein the steel sheet is subjected to reverse bending through rolls having a radius of 200 mm or more eight times or more in total during the holding, and cooling to a cooling stop temperature of 400° C. to 600° C. at an average cooling rate of 10° C./s or more.

15. A method for manufacturing the high-strength steel sheet according to claim 3, the method comprising a hot-rolling process including:

hot-rolling a steel slab having the chemical composition according to claim 3, cooling at an average cooling rate of 10° C./s to 30° C./s, and coiling at a coiling temperature of 470° C. to 700° C.;

a cold-rolling process in which the hot-rolled steel sheet obtained in the hot-rolling process is cold-rolled; and an annealing process including:

heating the cold-rolled steel sheet obtained in the cold-rolling process to an annealing temperature range of 750° C. to 900° C., holding the heated steel sheet at the annealing temperature range for 30 seconds to 200 seconds, wherein the steel sheet is subjected to reverse bending through rolls having a radius of 200 mm or more eight times or more in total during the holding, and cooling to a cooling stop temperature of 400° C. to 600° C. at an average cooling rate of 10° C./s or more.

16. A method for manufacturing the high-strength steel sheet according to claim 4, the method comprising a hot-rolling process including:

hot-rolling a steel slab having the chemical composition according to claim 4, cooling at an average cooling rate of 10° C./s to 30° C./s, and coiling at a coiling temperature of 470° C. to 700° C.;

a cold-rolling process in which the hot-rolled steel sheet obtained in the hot-rolling process is cold-rolled; and an annealing process including:

heating the cold-rolled steel sheet obtained in the cold-rolling process to an annealing temperature range of 750° C. to 900° C., holding the heated steel sheet at the annealing temperature range for 30 seconds to 200 seconds, wherein the steel sheet is subjected to reverse bending through rolls having a radius of 200 mm or more eight times or more in total during the holding, and cooling to a cooling stop temperature of 400° C. to 600° C. at an average cooling rate of 10° C./s or more.

17. The method for manufacturing a high-strength steel sheet according to claim 14, the method further comprising a coating process wherein the annealed steel sheet is subjected to a coating treatment after the annealing process.

18. The method for manufacturing a high-strength steel sheet according to claim 15, the method further comprising a coating process wherein the annealed steel sheet is subjected to a coating treatment after the annealing process.

19. The method for manufacturing a high-strength steel sheet according to claim 16, the method further comprising a coating process wherein the annealed steel sheet is subjected to a coating treatment after the annealing process.

20. The method for manufacturing a high-strength steel sheet according to claim 17, wherein the coating treatment is a galvanizing treatment or a galvannealing treatment.

21. The method for manufacturing a high-strength steel sheet according to claim 18, wherein the coating treatment is a galvanizing treatment or a galvannealing treatment.

22. The method for manufacturing a high-strength steel sheet according to claim 19, wherein the coating treatment is a galvanizing treatment or a galvannealing treatment.

* * * * *